US008985421B2

(12) United States Patent
Barbier

(10) Patent No.: US 8,985,421 B2
(45) Date of Patent: Mar. 24, 2015

(54) FEMININE HYGIENE ARTICLE HOLDER

(76) Inventor: Judy Barbier, Metairie, LA (US)

( * ) Notice: Subject to any disclaimer, the term of this patent is extended or adjusted under 35 U.S.C. 154(b) by 221 days.

(21) Appl. No.: 13/434,073

(22) Filed: Mar. 29, 2012

(65) Prior Publication Data

US 2012/0234886 A1 Sep. 20, 2012

Related U.S. Application Data

(63) Continuation-in-part of application No. 12/381,714, filed on Mar. 16, 2009, now abandoned.

(51) Int. Cl.
*A45F 5/00* (2006.01)
*A45C 11/00* (2006.01)

(52) U.S. Cl.
CPC ..... *A45C 11/00* (2013.01); *A45C 11/008* (2013.01)
USPC ..... 224/660; 224/222; 224/665; 224/587

(58) Field of Classification Search
USPC ..... 224/222, 578, 580, 587, 665, 660, 671, 224/676, 677, 250, 219–221
See application file for complete search history.

(56) References Cited

U.S. PATENT DOCUMENTS

| | | | | |
|---|---|---|---|---|
| 2,340,451 | A * | 2/1944 | Bronson | 224/222 |
| 3,277,599 | A | 10/1966 | Griffeth | |
| 3,813,017 | A | 5/1974 | Pimsleur | |
| 5,141,141 | A * | 8/1992 | Leone | 224/587 |
| 5,410,762 | A | 5/1995 | Maskovich | |
| 5,465,889 | A | 11/1995 | Smith | |
| 5,526,924 | A | 6/1996 | Klutznick | |
| 2005/0193476 | A1* | 9/2005 | Chinn | 2/247 |
| 2006/0011687 | A1* | 1/2006 | Wadley et al. | 224/587 |
| 2008/0006659 | A1* | 1/2008 | Cain | 224/222 |
| 2008/0190974 | A1* | 8/2008 | Finn | 224/267 |
| 2010/0230459 | A1* | 9/2010 | Barbier et al. | 224/660 |
| 2014/0054347 | A1* | 2/2014 | Warren | 224/587 |

* cited by examiner

*Primary Examiner* — Brian D Nash
*Assistant Examiner* — Corey Skurdal
(74) *Attorney, Agent, or Firm* — Keaty Law Firm, LLC

(57) ABSTRACT

A holder for a feminine hygiene article is secured on the user's body and retains an unused personal item in an inconspicuous position under the user's outer clothing. The holder is formed as a pouch, or pocket having a front panel and a back panel attached to the front panel. A belt formed from two accordion-style folded non-resilient portions is detachably secured to the holder body and to the user's waist, hips or thigh. One of the belt portions has an adhesive tab that is securable to a free end of the second portion, while an unwanted length of the first portion is detached along tear-off perforation lines. An adhesive strip near the open upper end secures the holder body to the user's body or undergarments.

6 Claims, 2 Drawing Sheets

FEMININE HYGIENE ARTICLE HOLDER

CROSS REFERENCE TO RELATED APPLICATIONS

This application is a continuation-in-part of my co-pending application Ser. No. 12/381,714 filed on Mar. 16, 2009 now abandoned, the full disclosure of which is incorporated by reference herein and priority of which is hereby claimed.

BACKGROUND OF THE INVENTION

This invention relates to a feminine sanitary protection article holder, and more particularly to a pouch for housing a feminine hygiene article in a discreet manner.

Personal hygiene products, such as sanitary napkins, panty liners and tampons are usually packaged for retail purposes in deformable containers such as pouches, sachets and the like. Such products and articles may be individually wrapped or stacked in a box housing ten or more of similar items. The boxes are often too bulky for carrying in a handbag or backpack. As a consequence, a user takes out several of such items from the box when the user expects to be away from home for several hours.

At work or at school, the user can retrieve one of the personal hygiene articles from her handbag or backpack and change the article in a discreet location. However, there are situations when the user may be embarrassed to openly remove the article from her bag and carry it through a roomful of people. For instance, when a class is in session and the user wishes to leave to attend to her personal hygiene, she may be reluctant to show the reason for her short departure to the entire class. An alternative of carrying an entire backpack may not be feasible.

Accordingly, there is a need to provide a holder for personal hygiene items that can be worn by the user in a discreet unobtrusive manner under clothing.

SUMMARY OF THE INVENTION

It is, therefore, an object of the present invention to provide a holder for a feminine hygiene article that can be positioned on the body of the user.

It is another object of the invention to provide a holder for a feminine hygiene article that can be secured to the user's body under clothing.

It is a further object of the invention to provide a holder for a feminine hygiene article that can be configured for housing a different type of product.

These and other objects of the invention are achieved through a provision of a disposable holder for a feminine hygiene article, which is formed as a flexible pocket or pouch. The holder comprises a front panel, a back panel attached to the front panel, a closed bottom and selectively closable top, with the front panel being secured to the back panel along the closed bottom and sides. A first attachment member is formed adjacent the top of the holder body; the first attachment member being formed by an adhesive strip that is normally covered by a removable cover. The first attachment member can attach the holder body directly to the user's body or undergarments.

A flexible non-resilient second attachment member forms a two-portion belt that can be sued to encircle the user's waist, hips or thigh. The two portions of the second attachment member extend from opposing sides of the holder body. The first portion has accordion-style folded section separated by tear-off perforated lines allowing the user to tear off unwanted part of the belt portion. The second portion also has accordion-style folded sections. A free end of the second portion carries an adhesive tab for joining with a free end of the first portion after the unwanted length of the first portion has been detached or torn off.

The holder of the present invention can be worn under the user's outer clothing and retain the personal hygiene item inconspicuously.

BRIEF DESCRIPTION OF THE DRAWINGS

Reference will now be made to the drawings, wherein like parts are designated by like numerals, and wherein.

DETAIL DESCRIPTION OF THE INVENTION

Figures 1, 2, 3:
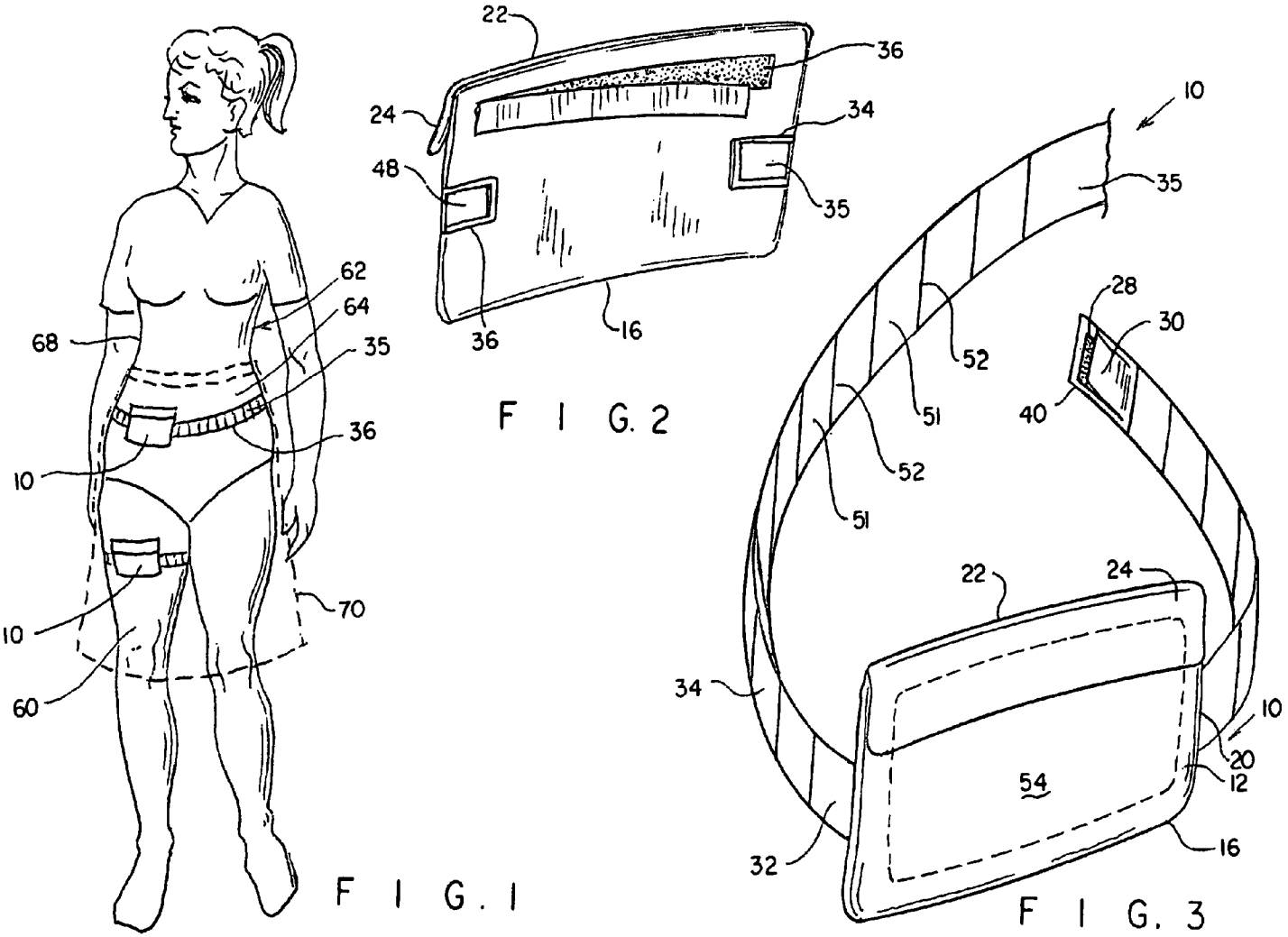
FIG. 1 illustrates different positions of the holder of the present invention on a user's body.
FIG. 2 is a back view of the holder with the belt in a folded position.
FIG. 3 is a front view of the feminine hygiene article holder of the present invention with the belt unfolded.
Figure 5:
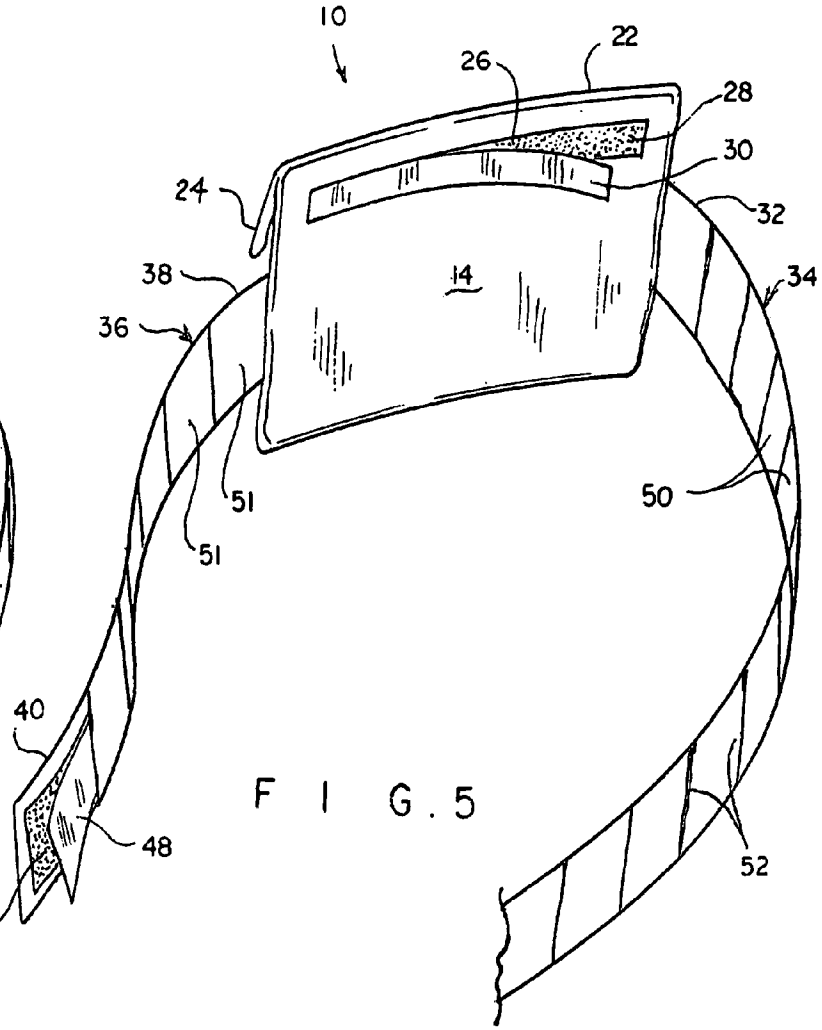
FIG. 5 is a back view of the holder showing a removable cover of an adhesive band.
Figure 4:
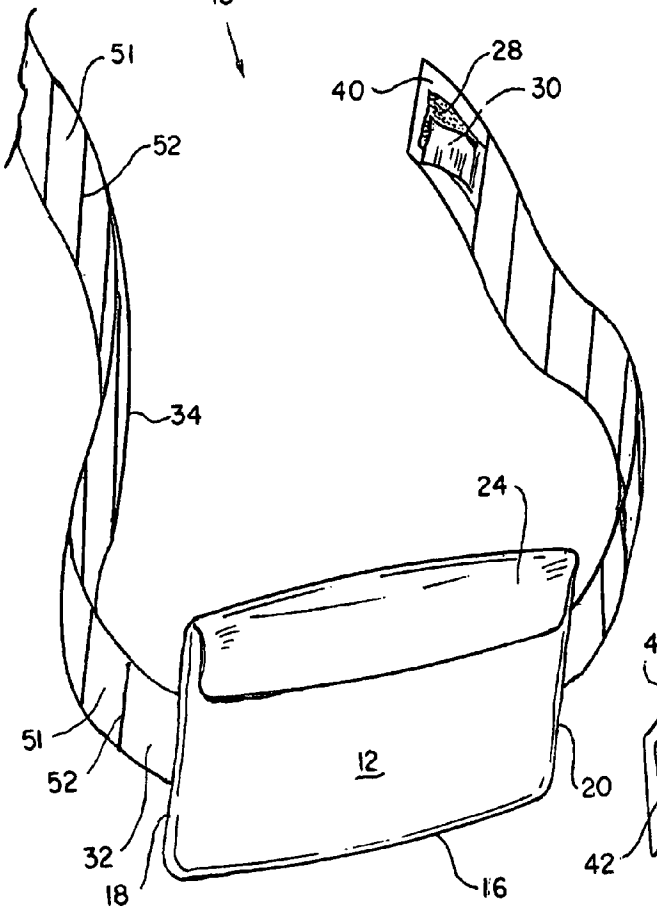
FIG. 4 is a back view of the holder with the belt unfolded.

Turning now to the drawings in more detail, numeral 10 designates the article holder in accordance with the present invention. The holder 10 comprises a flexible holder body having a front panel 12, a back panel 14 secured to the front panel 12, a closed bottom 16, a first closed side 18 and a second closed side 20. The back panel 14 can be secured to the front panel 12 along the bottom 16 and sides 18, 20 by stitching, adhesive, or by other suitable means. A top 22 of the holder 10 is open. An optional flap 24 selectively covers and uncovers the open top 22.

The back panel 14 has an exterior surface, which carries an attachment member 26. The attachment member 26 is may be a band of double-sided adhesive tape 28, which is secured to extend along at least a portion of the upper end 22. The attachment member 26 also comprises a removable cover strip 30, which normally covers the outer adhesive surface of the band 28. When the cover strip is removed, the adhesive surface of the band 28 is exposed allowing the user to press the band 28 to the user's body and thereby attach the upper portion of the holder 10 to the user's body. The attachment member 26 has a predetermined length, which can be almost as long as the horizontal dimensions of the holder 10.

Alternatively, the double-sided adhesive tape 28 can be substituted by a layer of an adhesive deposited directly on the back panel 14 and covered with a removable cover strip 30, which is removed to expose the adhesive layer immediately before positioning of the holder 10 on the user's body.

Extending from the first side 18 is a first portion 34 of a securing belt 35. The belt 35 is formed from a non-resilient flexible deformable material. The first portion 34 comprises a secured part 32, which is affixed to the first side 18 by stitching, adhesive and the like and a free end 35. A second portion 36 of the securing belt extends from the second side 20 in alignment with the first portion 34 but in an opposite direction. The second portion 36 of the securing belt has an attached end 38 and a free end 40.

The free end 40 of the second portion of the securing belt is provided with a securing tab 42. The securing tab 42 comprises a piece of a double sided adhesive tape 46 and a removable tab cover 48, which normally covers the adhesive surface of the tape 46. As an alternative, the double-sided tape 46 can be substituted by a layer of adhesive deposited on the surface of the second portion 36 of the belt. The tab cover 48 will cover the adhesive surface until such time as the belt is secured on the user's body.

The first portion 34 and the second portion 36 of the securing belt is folded accordion style and lies flat against the back panel 14, as shown in FIG. 2. The folded sections 50, 51 of the securing belt portions 34 and 36, respectively, can be configured as one-inch sections. When folded in a manner shown in FIG. 2, the two portions of the securing belt add negligible thickness to the holder 10.

The first portion 34 of the securing belt is provided with perforations 52 formed between the folded sections 50. The perforations allow the user to tear off the unnecessary length of the first portion of the securing belt. The second portion 36 of the securing belt does not have perforations and its length remains constant. In one aspect of the invention, the length of the second portion 36 was selected to be about six inches.

The holder 10 can be used for retaining a feminine hygiene item 54 shown in phantom lines in FIG. 3. The product 54 can be a pantiliner, a pad, a tampon, and the like. Depending on the shape of the hygiene article to be retained in the holder 10, the vertical and horizontal dimensions of the holder 10 can differ. The holder 10 can be formed as a rectangle, a square, an oval, etc.

In one aspect of the invention, the holder 10 is made disposable. It can be manufactured from an absorbent white tissue with polyethylene backing to protect clothing of the user. Of course, other materials can be used as well, such as for instance thin plastic, natural fiber material, etc.

In operation, the user positions a feminine hygiene product 54 in the holder 10 through the open top 22. If flap 24 is provided, the flap is used to cover the open top 22. The user then peels off the cover 30 to expose the adhesive surface of the attachment member 26. The user presses the adhesive to the user's body or undergarments thereby securing the upper part of the holder 10 in a desired location under the user's outer closing. As can be seen in FIG. 1, the location can be a thigh 60 of a user 62 or a hip 64, or waist 68.

Once the holder 10 is at least partially secured on the body, the user unfolds the accordion-folded belt and extends the portions 34, 36 around the thigh, hips, waist, etc. Depending on the size of the user's anatomy, the first portion 34 can be extended between 20 and 60 inches, while the second portion 36 is extended completely to free the end 40. Once the belt 35 encircles the user's thigh (waist, hip), the remainder of the first portion is torn off along the perforations 52.

The user 62 then peels off the tab cover 48 to expose the adhesive 46. The adhesive surface 46 is pressed against the free end of the first portion 34 thus forming the belt 35 about the user's thigh, waist, or hips. When worn by a user, the belt 35 encircles the thigh (hips, waist) of the user 62 allowing the holder 10 to be retained under the user's outer closing 70 in a discrete inconspicuous manner. The open upper end 22 of the holder 10 faces upwardly and allows the user to remove the article 54 from the holder 10 when necessary. The holder 10 can then be disposed off in an environmentally responsible manner.

If desired, the user 62 can first allow the first portion 34 and the second portion 36 to unfold before attaching the holder body using the first attachment member 26.

The holder 10 can be made of a wide variety of flexible materials, such as textiles, nylon, polyester, thin plastic sheet and the like. The material forming the front and back panels may be neutral in color or can be decorated with any special design.

Many changes and modifications can be made in the design of the present invention without departing from the spirit thereof. We therefore pray that our rights to the present invention be limited only by the scope of the appended claims.

I claim:

1. A method of inconspicuously positioning a feminine hygiene article under a user's outer clothing, comprising the steps:

providing a flexible holder body comprising a closed bottom end, an open upper end, opposing sides, a front panel and a back panel attached to the front panel along the bottom end and the sides, and a means for securing the holder body on a body of a user, said securing means comprising a first attachment member extending along the upper end of the back panel and a foldable non-resilient second attachment member extending from the sides of the holder body;

positioning a feminine hygiene article in the holder body;

attaching the holder body to the user's body or undergarments using the first attachment member;

unfolding the second attachment member and forming a two-portion belt;

positioning the second attachment member on the user's body by securing free ends of the two-portion belt about the user's waist, thigh, or hips, said two-portion belt comprising a first portion and a second portion folded accordion style, and comprising a step providing the first portion of the belt with a plurality of folded sections separated by tear-off perforations and removing unwanted length of the first portion of the belt prior to securing free ends of the two-portion belt about the user's waist, thigh, or hips.

2. The method of claim 1, comprising a step of providing the first attachment member with an adhesive strip and normally covering the adhesive strip with a removable cover.

3. The method of claim 2, comprising a step of removing the removable cover immediately prior to attaching the holder to the user's body or undergarments using the first attachment member.

4. The method of claim 1, comprising a step of providing an attachment tab on the free end of the second portion.

5. The method of claim 4, wherein the attachment tab comprises an adhesive tab and a tab cover normally covering the adhesive tab.

6. The method of claim 5, comprising a step of removing the tab cover immediately prior to securing the free ends of the first portion and the second portion.

* * * * *